United States Patent [19]

Martin et al.

[11] 4,373,869

[45] Feb. 15, 1983

[54] WARM-UP VALVE IN A VARIABLE DISPLACEMENT SYSTEM

[75] Inventors: Robert J. Martin, Hutchinson; Loren L. Alderson, Nickerson; Jerry F. Carlin, Hutchinson, all of Kans.

[73] Assignee: The Cessna Aircraft Company, Wichita, Kans.

[21] Appl. No.: 180,550

[22] Filed: Aug. 22, 1980

[51] Int. Cl.[3] ..... F04B 49/08

[52] U.S. Cl. ..... 417/213; 60/329; 60/452; 60/468; 417/218; 417/292

[58] Field of Search ..... 417/213, 218–222, 417/292; 60/329, 468, 452

[56] References Cited

U.S. PATENT DOCUMENTS

| | | | |
|---|---|---|---|
| 2,238,061 | 4/1941 | Kendrick | 417/357 |
| 2,255,783 | 9/1941 | Kendrick | 60/329 |
| 3,186,353 | 6/1965 | Taplin | 417/218 |
| 3,530,958 | 9/1970 | Brannon et al. | 60/329 X |
| 4,107,924 | 8/1978 | Dezelan | 417/218 X |

*Primary Examiner*—Edward K. Look

*Attorney, Agent, or Firm*—Edward L. Brown, Jr.

[57] ABSTRACT

A warm-up valve in a load responsive hydraulic system which connects the pump discharge pressure with the pump compensator while bypassing to reservoir a partial capacity of the pump. When proper reservoir temperature is reached, a thermostatically controlled solenoid closes the warm-up valve causing the pump to return to low pressure standby.

11 Claims, 2 Drawing Figures

WARM-UP VALVE IN A VARIABLE DISPLACEMENT SYSTEM

BACKGROUND OF THE INVENTION

Figure 1:
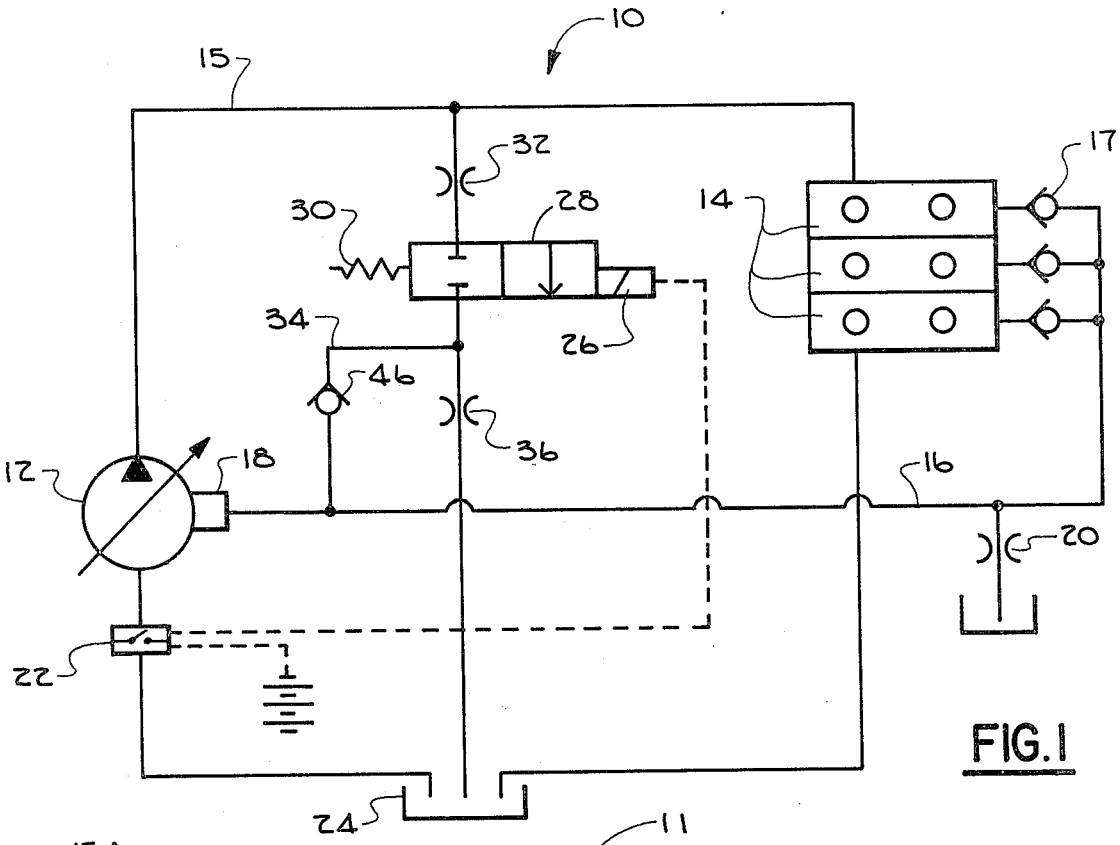

Modern hydraulic power transmissions generally include a variable displacement pump, one or more motors and controls which direct the displacement of the pump to comply with the needs of the motors. These controls keep the system pressure from exceeding maximum limits and also maintain flow at preset levels. Systems of this nature are typified in U.S. Pat. No. 3,508,847. A further advancement of this type of system are those generally referred to as "load responsive" which permits the variable displacement pump to maintain only that flow and pressure level necessary to move a particular load. This type of system is typified in U.S. Pat. Nos. 3,401,521 and 4,037,410. One of the drawbacks to all of these above-mentioned systems is that the pressure and flow controls are designed to function within a set oil temperature range and quite often the system is quite cold, as would be the situation when a tractor is left outside in the winter. Before functioning properly, the oil reservoirs must be warmed-up, which is quite difficult with closed center systems of this type.

The present invention solves this initial warm-up problem by providing a valve and a control system which circulates sufficient oil through the pump and system to warm-up the oil while not allowing the pump load to exceed the idle torque output of the engine and stall the machine. One prior art method of dealing with thick cold oil is shown in U.S. Pat. No. 3,637,327 wherein the tension on the pressure compensating spool of the variable displacement pump is varied by use of a bimetallic Bellville spring. The system oil is exposed to the Bellville spring causing the spring force on the pressure compensating spool to vary in accordance with the temperature of the oil so as to provide a temperature compensated system which maintains a fairly constant pressure level regardless of the oil temperature.

The present invention deals with this increased viscosity problem automatically with a warm-up valve which in its cold condition directly connects pump discharge flow to the pump compensator while allowing a limited percentage of the pump's flow capacity to flow back to reservoir at a sufficient pressure to warm-up the system. By allowing a limited capacity of oil to be pumped back to the reservoir, the torque output of the engine in idle or fast-idle speeds will not be overcome by the pump which would stall the engine. The valve is also thermostatically controlled so that when the oil temperature reaches a certain operating temperature level, the direct pressure from the pump is cut-off to the pump compensator thereby causing the pump to return to a low pressure standby condition.

It is therefore the principal object of the present invention to provide a warm-up valve in variable displacement systems which automatically circulates to reservoir a limited amount of oil in an idle condition to warm the reservoir while not exceeding the torque output of the engine in idle.

Another object of the present invention is to provide a warm-up valve in a load responsive system which automatically sets the pump compensator at a flow and pressure rate sufficient to warm the oil in the reservoir while not exceeding the torque output of the engine.

Another object of the present invention is to provide a circulating warm-up circuit which can be manually overridden by actuating one of the directional control valves of the system.

A further object of the present invention is to provide a warm-up circuit which at cranking RPM circulates flow to reservoir at a minimum pressure build-up.

Figure 2:
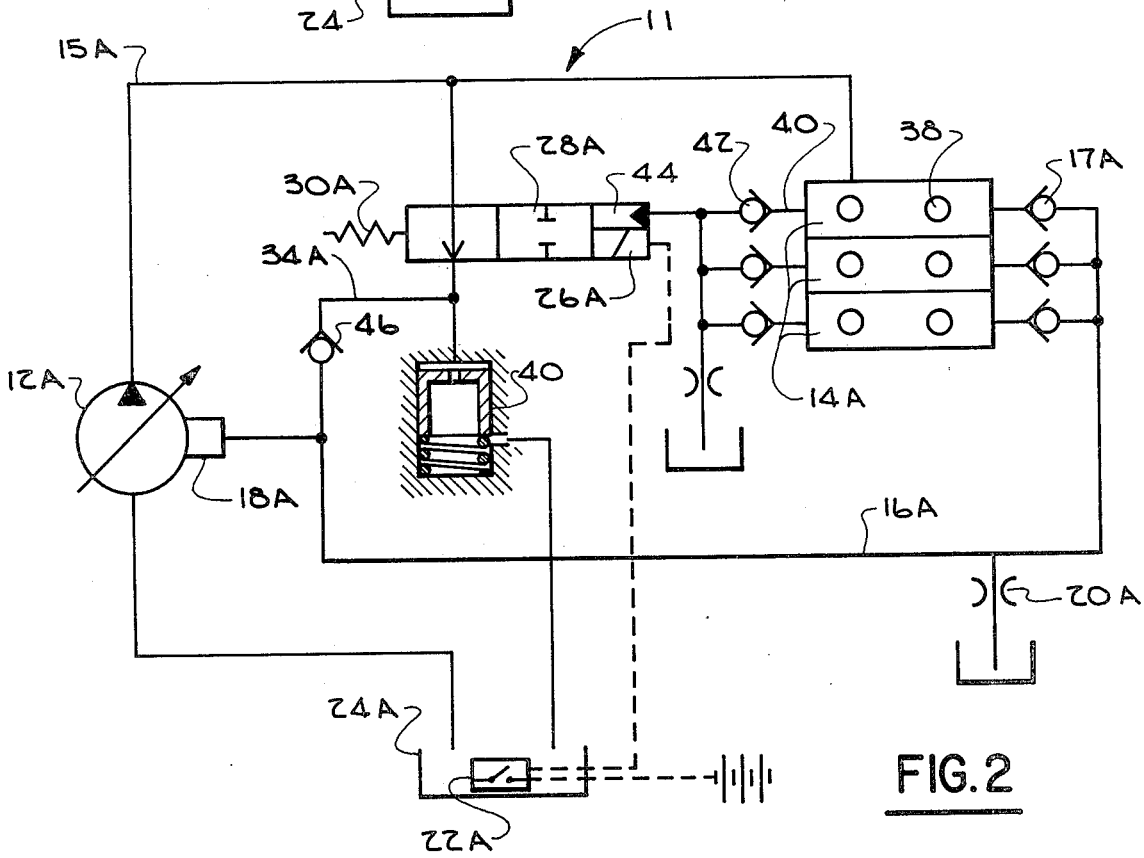

Other objects and advantages of the present invention will become more apparent to those skilled in the art from the following detailed description which proceeds with reference to the accompanying drawings wherein:

FIG. 1 is a schematic view of the warm-up valve of the present invention in a load responsive system; and FIG. 2 is a schematic view of a modified form of the warm-up valve in a load responsive system.

With reference to FIG. 1, the load responsive hydraulic system is generally described by reference numeral 10. The system includes a variable displacement pump 12 which supplies a stack of directional control valves 14 which in turn supply motors not shown in the drawing. Load responsive systems, which are typified in U.S. Pat. No. 3,401,521, sense the load on a motor by opening a signal passage so that the load pressure can be felt by the pump compensator thereby bringing the pump discharge level up to a level slightly exceeding the load. In the FIG. 1 schematic, sensing line 16 connects the load pressure with pump compensator 18 as the spool of valve 14 which is not shown in the drawing, is moved towards an actuating position. The compensator 18 which is the type described in detail in U.S. Pat. No. 4,037,410, strokes the pump out to a flow level sufficient to create a pressure slightly exceeding the load experienced by the motor. Located in sensing line 16 is a bleed orifice 20 which allows the sensing line pressure to drop to zero when the control valve spools are neutrally positioned. Located in the pump intake line between the reservoir 24 and pump 12, is a thermostatically actuated switch 22 which senses the reservoir oil temperature. The contacts of switch 22 are normally closed thereby energizing solenoid 26 which maintains warm-up valve 28 in its open position. Valve 28 is a two-way two-position spool valve normally held in the closed position by spring 30. Valve 28 can be either directly solenoid-powered or actuated by a pilot cylinder which in turn is controlled by solenoid 26.

Warm-up valve 28 connects the pump discharge line 15 with reservoir 24 in its open position, allowing flow to circulate through the reservoir. Flow through the valve 28 is controlled by orifice 32 positioned upstream of the valve, with the pressure drop across the orifice being sensed in a second sensing line 34 connected to the pump compensator 18. Orifice 32 sets the flow rate of pump 12, while orifice 36 sets the pressure level developed by the pump. By adjusting the size of orifices 32 and 36, the flow level and pressure level can be adjusted to achieve the desired output of hydraulic horsepower and consequently, the rate of oil warm-up of the system. The orifices 32 and 36 are also sized so that at cranking RPM there is no substantial pressure build-up which would overcome starting torque even in very cold temperatures.

FIG. 2 illustrates a slightly different system generally recognized by reference numeral 11, which includes a similar variable displacement pump 12A controlled by compensator 18A which is supplied by signals through either sensing line 16A or sensing line 34A. While the systems illustrated in both FIGS. 1 and 2 are of the "load responsive" type, the warm-up valve of the present invention would have equal utility in a strictly pressure compensated closed center system or a pressure and flow compensated system similar to that shown in U.S. Pat. No. 3,508,847. Warm-up valve 28A incorporates a flow limiter 40 positioned downstream from the valve 28A and sensing line 34A. In its cold start-up position, as illustrated in the drawing, pump discharge flow in line 15A passes over flow limiter 50 to reservoir 24A and also in a parallel path through sensing line 34A to the pump compensator 18A. The pump discharge pressure being felt on compensator 18A will cause the pump to increase its stroke and flow across flow limiter 40 until a certain flow rate is achieved, as for example 30% of the pump's capacity, at which time the spool in flow limiter 40 moves downwardly and begins to restrict the flow to reservoir 24A, thereby building pressure in the pump discharge line 15A. Compensator 18A will sense this pressure build-up, and bring the pump 12A to its maximum pressure compensating level, at 30% of the pump's capacity. When the oil in reservoir 24 reaches its normal operating temperature, thermostatic switch 22A closes energizing solenoid 26A and shifts warm-up valve 28A to its closed position. In its closed position, pump discharge pressure is cut-off from compensator 18A causing the pressure in sensing lines 34A and 16A to go to zero. With zero sensing pressure at the compensator 18A, pump 12A will stroke back to its low pressure standby condition, of for example 200 PSI. With valve 14A in a neutral position, there is no flow across check valve 17A or pressure in sensing line 16A. However, once the valve spool in valve 14A, not shown in the drawing, is moved towards a work position, pump discharge pressure in line 15A is opened into sensing line 16A causing the pressure to build until it reaches that pressure being held by the load experienced in work port 38.

Warm-up valve 28A can be overridden in a cold condition whenever control valve 14A is moved to an operative position. When the valve spool in valve 14A begins to move towards an operative position, pilot line 40 is pressurized flowing across check valve 42 and actuating servo cylinder 44. Servo cylinder 44 in turn shifts warm-up valve 28A against spring 30A to its closed position thereby shutting off warm-up flow across flow limiter 40. This manual override allows control valve 14A to supply a work function even when the oil is cold.

FIG. 1 OPERATION

Certain hydrostatic systems, when left in the cold are very difficult to start, in light of the viscosity of the cold oil. Warm-up valve 28 of the present invention bypasses a certain percentage of the pump discharge oil to reservoir so as to relieve starting torque when the engine is being cranked. In a cold oil condition, the contacts of thermostatically actuated switch 22 are closed, thereby energizing solenoid 26 and holding warm-up valve 28 in its open position against the action of spring 30. With the pump discharge pressure felt by compensator 18 through sensing line 34, orifice 32 functions as a flow control orifice for pump 12, and thereby strokes pump 12 out to a pre-established flow rate which might be 30% of its capacity. Downstream orifice 36 controls the pressure level to which pump 12 will rise. Once the temperature setting of thermostatic switch 22 is reached, solenoid 26 is de-energized and spring 30 closes valve 28 thereby returning the sensing pressure at compensator 18 to zero so that the pump returns to a low pressure standby condition. When the spool in the control valve 14 is actuated, sensing line 16 is open to pump discharge pressure allowing flow across check valve 17 into compensator 18 until that pressure level reaches that of the load. The load pressure sensing line 16 is prevented from backflowing in second sensing line 34 by check valve 46 whenever the load is greater than pump discharge pressure in the cold condition. Compensator 18 thereby increases the pump stroke so that the pump discharge pressure rises to a preset amount above the load.

Having described the invention with sufficient clarity to enable those familiar with the art to construct and use it, we claim:

1. A warm-up valve in a system having a variable displacement pressure and flow compensated pump supplying at least one function through at least one directional control valve with a signal sensing line from the control valve to the compensator on the pump, the warm-up valve comprising:

a temperature-actuated servo means sensing the system reservoir temperature;

a valve means positioned in a line connecting the pump discharge to reservoir, said means being actuated by said servo means having a spool which in its first position opens the pump discharge to the pump compensator and allows a controlled amount of the pump capacity to return to reservoir;

the valve spool having a second position, when actuated by the servo means, which blocks the pump discharge to the pump compensator and to reservoir.

2. A warm-up valve as set forth in claim 1, wherein the valve means includes a flow limiter positioned downstream of the valve spool in the flow path to the reservoir which allows a prearranged flow rate to pass before blocking further flow.

3. A warm-up valve as set forth in claim 1, wherein the valve means includes a second servo means connected to the valve spool which when pressurized moves the valve spool to its second position independent of the first servo means, and pilot passage means connecting the second servo with said directional control valve so that the pilot passage is pressurized whenever the directional control valve is moved to an actuating position.

4. A warm-up valve as set forth in claim 1, wherein the valve means includes a flow limiter positioned downstream of the valve spool in the flow path to the reservoir which allows a prearranged flow rate to pass before blocking further flow, and a second servo means connected to the valve spool which when pressurized moves the valve spool to its second position independent of the first servo means, and pilot passage means connecting the second servo with said directional control valve so that the pilot passage is pressurized whenever the directional control valve is moved to an actuating position.

5. A warm-up valve as set forth in claim 1, wherein the valve means includes a first fixed restriction upstream of the valve spool between the pump discharge and the valve means to provide a pressure drop for the flow across the valve means and a second fixed restriction downstream of the valve spool between the valve spool and reservoir to provide said limited flow to reservoir and create back pressure at the pump compensator.

6. A warm-up valve as set forth in claim 1, wherein the servo means includes a spring means urging the spool in one direction, a solenoid urging the spool in the opposite direction and a thermostatically actuated switch in the reservoir connected to the solenoid.

7. A warm-up valve in a system including a variable displacement pump having a pressure compensator which supplies at least one function through at least one directional control valve, the warm-up valve comprising:

a two-position, two way valve means positioned in a line connecting the pump discharge to reservoir, said means having a spool which in its first position opens the pump discharge to the pump compensator while allowing a controlled amount of pump capacity to return to reservoir; the valve spool having a second position, which blocks the pump discharge to the compensator and to the reservoir; and a temperature-actuated servo means sensing the system reservoir temperature, the valve means being actuated by said servo means.

8. A warm-up valve as set forth in claim 7, wherein the valve means includes a flow limiter positioned downstream of the valve spool in the flow path to the reservoir which allows a prearranged flow rate to pass before blocking further flow.

9. A warm-up valve as set forth in claim 7, wherein the valve means includes a second servo means connected to the valve spool which when pressurized moves the valve spool to its second position independent of the first servo means, and pilot passage means connecting the second servo with said directional control valve so that the pilot passage is pressurized whenever the directional control valve is moved to an actuating position.

10. A warm-up valve as set forth in claim 7, wherein the valve means includes a first fixed restriction upstream of the valve spool between the pump discharge and the valve means to provide a pressure drop for the flow across the valve means and a second fixed restriction downstream of the valve spool between the valve spool and reservoir to provide said limited flow to reservoir and create back pressure at the pump compensator.

11. A warm-up valve as set forth in claim 7, wherein the servo means includes a spring means urging the spool in one direction, a solenoid urging the spool in the opposite direction and a thermostatically actuated switch in the reservoir connected to the solenoid.

* * * * *